United States Patent [19]

MacCarthy

[11] 4,437,261

[45] Mar. 20, 1984

[54] YO-YO WITH TWIST-RESISTANT STRING

[76] Inventor: Patrick MacCarthy, 37 Mines Park, Golden, Colo. 80401

[21] Appl. No.: 293,797

[22] Filed: Aug. 18, 1981

Related U.S. Application Data

[63] Continuation-in-part of Ser. No. 138,729, Apr. 9, 1980, Pat. No. 4,290,224.

[51] Int. Cl.[3] ..... A63H 1/30

[52] U.S. Cl. ..... 46/61

[58] Field of Search ..... 46/61, 63, 67, 70, 71

[56] References Cited

U.S. PATENT DOCUMENTS

| | | | |
|---|---|---|---|
| 1,864,318 | 6/1932 | Powell | 46/61 |
| 2,773,328 | 12/1956 | Fraenkel et al. | 46/61 |
| 2,975,547 | 3/1961 | Greve | 46/61 X |
| 3,207,508 | 9/1965 | Klemke | 46/61 X |
| 3,228,140 | 1/1966 | White | 46/61 |
| 4,273,275 | 6/1981 | Vadnais | 46/61 X |

FOREIGN PATENT DOCUMENTS

| | | | |
|---|---|---|---|
| 757917 | 10/1933 | France | 46/61 |
| 209288 | 1/1924 | United Kingdom | 46/61 |
| 392002 | 5/1933 | United Kingdom | 46/61 |
| 1408251 | 10/1975 | United Kingdom | 46/61 |

OTHER PUBLICATIONS

Washington Star-News; Feb. 2, 1974, p. A-3; Assoc. Press item "Down . . . and Up".

Renner-Experimental Fun with the Yo-Yo-Dodd, Mead & Co., N.Y. ©1979-pp. 10,11,14,15,18,19.

*Primary Examiner*—F. Barry Shay

*Attorney, Agent, or Firm*—Oblon, Fisher, Spivak, McClelland & Maier

[57] ABSTRACT

A toy capable of combined rotational and translational motion. Two parallel discs are connected through their centers by a single axle. The axle is supported from a string connected at a position between the two discs. Said string is of a twist-resistant type, offering a greater torsional resistance to twisting about the axis of the string than conventional yo-yo strings. The string may be anchored to the axle in a non-sleeping mode, or it may be looped around the axle allowing the yo-yo to sleep. In order to operate the toy, the end of the string opposite that which is connected to the yo-yo axle is held by the user, and an up-and-down gentle motion is imparted to the toy.

13 Claims, 5 Drawing Figures

YO-YO WITH TWIST-RESISTANT STRING

BACKGROUND OF THE INVENTION

Cross-references

This application is a continuation-in-part of my copending U.S. patent application Ser. No. 138,729 (now U.S. Pat. No. 4,290,224) which was filed on Apr. 9, 1980 and entitled: "Tape-Supported Yo-Yo".

FIELD OF THE INVENTION

The present invention relates to the concept of using a twist-resistant string in association with yo-yos, and specifically to the use of a twist-resistant string to hinder precessional rotation of the yo-yo.

BACKGROUND OF THE INVENTION

Various toys having combined rotational motion about a horizontal axis and a translational motion in a vertical direction have been developed. One type of such toy is commonly referred to as a yo-yo. This toy has also been referred to as a return top; quiz; Prince of Wales' toy; disc, Coblenz, Incroyable; Bandalore; or emigrette. According to the Patent Office classification, a yo-yo is a tethered aerial top. A yo-yo consists of a single axle having two parallel positioned discs centrally connected to the axle. A string is connected to the axle between the discs at one end and is held in the user's hand at the other end. The string is wrapped around the axle by the user and the yo-yo is then forced downward. Upon being forced downward, the string unwinds thereby providing a rotational momentum to the discs. Once the string has been completely unwound, the rotational momentum of the discs continues to exist, thus causing the string to be rewound around the axle as it travels upward vertically toward the user's hand. The conventional structure of this yo-yo is disclosed within U.S. Pat. No. 3,263,361 to Bowden, and U.S. Pat. No. 3,256,635 to Radovan.

In another variation of the yo-yo, the string is not actually secured to, or anchored to, the axle; rather, it is looped about the axle somewhat loosely, allowing the yo-yo body to spin freely in the looped string. Such rotational motion of a yo-yo, unaccompanied by translational motion along the string direction, is referred to as "sleeping". The sleeping yo-yo can be withdrawn from its sleep by jerking the string, or alternatively, by relaxing the tension in the string. The conventional sleeper-type yo-yo is discussed in the specification of Stivers and Ennis, U.S. Pat. No. 2,629,202. Another mechanism for allowing the yo-yo to sleep, but which does not involve a looped string, is discussed in Isaacson, U.S. Pat. No. 3,175,326. Isaacson's device involves an axle which is rotatably supported in a ball-bearing system.

The conventional yo-yo structure as described above has achieved tremendous success in the past as an entertaining toy. Furthermore, certain modifications of that conventional yo-yo such as that disclosed within Bowden or Isaacson may have achieved success as entertaining toys. However, the conventional yo-yo structure has a pronounced limitation when used by inexperienced or younger operators. The limitation is apparent to even the most casual observer and resides in the difficulty of maintaining the balance or equilibrium of the toy during use. The inability of the inexperienced user to maintain this balance results in a wobbling and precessional motion of the yo-yo during operation. The operator loses control of the yo-yo when the balance of the toy is disturbed, thus causing the yo-yo to slow its rotational motion and thereby lose its ability to maintain vertical translational motion.

An examination of the prior art in this field shows that it is comprised of yo-yo toys of conventional structure, conventional yo-yos with slight aesthetic modifications, yo-yos whose structure has been modified with the intent of providing improved stability, and yo-yos whose conventional structure has been modified with the intent of providing additional versatility and function.

One of the features which is repeatedly emphasized as being of value in the dynamics of yo-yo motion is an increased moment of inertia for the yo-yo body. Assuming a fixed mass for the yo-yo body, this is achieved by distributing as much of the mass as possible close to the outer rim of the yo-yo. This topic is discussed in a number of U.S. Pat. Nos. such as 59,745 to Haven and Hettrich; 668,829 to Boehme; 3,175,326 to Isaacson; and 3,805,443 to Duncan. Such inertial rings or flywheels are found on a number of commercially available yo-yos.

On the other hand, the smaller the moment of inertia of a yo-yo body, the greater the angular velocity which can be imparted to it by a given impulse or torque. This increases the 'speed' of a particular yo-yo, as discussed by Stivers and Ennis in U.S. Pat. No. 2,629,202.

In the context of this specification, the term "stability of yo-yo" is intended to mean the tendency of the yo-yo axle to remain in horizontal alignment, and its tendency to return to this alignment if it is displaced therefrom by some means. The term "stability of yo-yo" also refers to the facility with which proper yo-yo operation can be re-established after it experiences severe wobbling or precessional rotation; the greater the stability of the yo-yo, the easier it is to re-establish proper operation after it encounters difficulty. "Stability of yo-yo" also refers to its tendency to resist engaging in precessional rotation.

In the specification and claims of this application, the term "twist-resistant string" means that the string offers a significant barrier or opposition to twisting about the longitudinal axis of the string compared to conventional yo-yo strings which have been used on commercial yo-yos up to the present time. Of course, in order to be useful for a yo-yo, such a twist-resistant string must be flexible about axes transverse to the longitudinal axis of the string in order that the string may wind about the yo-yo axle.

As an indication of the increased versatility of the yo-yo presented herein, the user will find that the yo-yo can be handled quite roughly during its operation, and still, the user continues to retain control of its motion. The ability of the twist-resistant string to resist twisting about its longitudinal axis hinders the yo-yo from engaging in precessional rotation and also facilitates the yo-yo in recovering from precessional motion when such does occur.

SUMMARY OF THE INVENTION

The present invention is comprised of a single axle which connects two parallel discs at their centers. A twist-resistant string is connected to the axle, between the discs. In order to operate the yo-yo, the user must hold the string and move it gently up and down. Precession of the yo-yo body is hindered by the torsional resistance of the string.

In a particular embodiment of the present invention, a system of one or more swivels is attached to the end of the twist-resistant string opposite the end of attachment to the axle. A holding ring is attached to the swivel system. In order to operate the preferred embodiment of the present invention, the user places his finger through the holding ring. After winding the string around the axle, the body of the yo-yo is allowed to fall. Thereafter, gentle up and down oscillatory motion is maintained to keep the body of the yo-yo rotating, and thus sustaining its vertical up-and-down motion. The swivel system, if present, and including one or more swivels, allows relaxation of the rotational tension in the string resulting from twisting of the string about a vertical axis. This significantly facilitates operation of the toy.

In accordance with the above-presented description of the invention, and a further description which will follow, it is the primary object of this invention to provide a toy comprised of an axle; two discs supported at their center points on said axle; a twist-resistant string connected to said axle.

Another object of the present invention is to provide a yo-yo which is comprised of an axle; two discs supported at their center points on said axle; a twist-resistant string looped about said axle.

Another object of the present invention is to provide a yo-yo which is comprised of an axle; two discs supported at their center points on said axle; a twist-resistant string connected at one of its ends to said axle; a system of one or more swivels connected to the opposite end of said string; and a holding ring attached to said swivel system.

Another object of the present invention is to provide a yo-yo toy that is more stable than a conventional yo-yo toy.

Still another object of the present invention is to present a yo-yo toy which is simple in design and in construction.

Another object of the invention is to present a yo-yo toy which possesses such greatly increased stability that it resuls in increased versatility of the function of the toy.

Another object of the present invention is to present a yo-yo toy of such design that difficulties due to precessional rotation can be readily rectified and proper yo-yo operation reinstated without having to stop the yo-yo and start all over again.

Another object of the present invention is to present a yo-yo toy containing a twist-resistant string which offers considerable resistance to precession of the yo-yo body about the axis of the string.

Another object of the present invention is to provide a yo-yo toy possessing the above-listed characteristics, and which, in addition, is capable of sleeping.

These and other objects and advantages of the present invention will become apparent to those skilled in the art upon reading the details of construction and use as more fully set forth below, reference being made to the accompanying drawings forming a part hereof wherein like numerals refer to like parts throughout.

DESCRIPTION OF THE PREFERRED EMBODIMENTS

Before the present "yo-yo with twist-resistant string" is described in detail in terms of its preferred embodiments, it is to be understood that this invention is not limited to the particular arrangement of parts shown, as such devices may, of course, vary. It is also to be understood that the terminology used herein is for the purpose of describing particular embodiments only and is not intended to be limiting since the scope of the present invention will be limited only by the appended claims.

Figure 1:
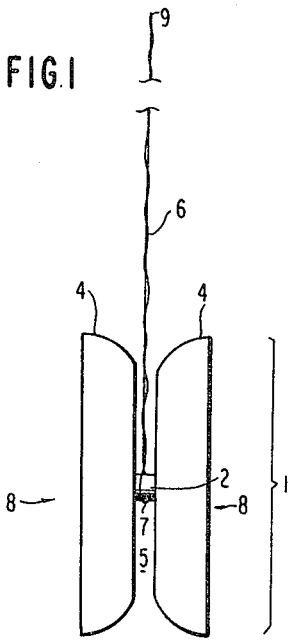
FIG. 1 is a plain front view of the present yo-yo toy.

Referring now to the drawings, and to FIG. 1 in particular, which shows a plain front view of the invention. The body of the yo-yo is referred to generally by the number 1. The body contains a single axle 2. The axle 2 has a pair of identical discs 4 positioned at their center points on the axle 2. The discs 4 are typically circular in crosssection and are separated from each other, leaving a groove 5 between the two discs 4. The discs 4 may be hollow or solid, and their faces may be flat or curved.

Figure 2:
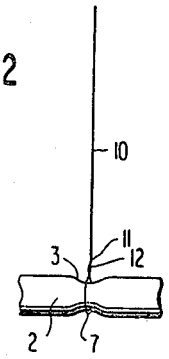
FIG. 2 is a view of the axle showing the groove or recess which may exist in the axle as well as an alternative embodiment of the looped string.
Figure 2:
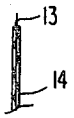

A twist-resistant string 6 is looped 7 about axle 2. The axle 2 may rotate in the loop 7. The axle 2 may contain a circular recess or groove 3, positioned in a plane normal to axis of axle 2, as illustrated in FIG. 2. The groove 3, if present, assures that the loop 7 is constantly centrally positioned on the axle 2. This type of groove in the axle is found in some commercially available yo-yos, and is described by Stivers and Ennis, U.S. Pat. No. 2,629,202.

The loop 7 may be formed by doubling the string 6 back upon itself and tying the two ends together close to the point 9 where the string is held by one's hand. Alternatively, the loop 7 may be formed by means of a bowline knot.

In an alternative modification of the invention, the string 6 is not looped about the axle 2 in such a manner that the axle 2 of the yo-yo can readily rotate at the end of the extended string. Rather, the string 6 is looped about the axle 2 more than once, thus increasing the friction between the string 6 and the axle 2 to such a degree that the yo-yo cannot sleep. Alternatively, the string 6 may be actually tied or anchored to the yo-yo axle 2, preventing the yo-yo from sleeping.

The string is of a twist-resistant type; this string may be comprised of natural fibers or synthetic material, or may be a composite of both. The twist-resistance may be due to the inherent nature of the material, or it may be due to the manner in which its component material or materials is/are woven or otherwise bound together. A basic requirement for the string in a yo-yo is that the string be readily able to wrap about the axle of the yo-yo. The present invention requires a string which offers a significant resistance to twisting about an axis lying along its length, while still being able to wind about the yo-yo axle. At first it may appear that these two requirements are contradictory. The resolution of this dilemma, in conjunction with the recognition of the basic precessional problem, constitutes the essence of the present invention. The solution is readily explained as follows: a bicycle chain, and devices of similar construction, possess a flexibility which allows them to wrap around an axle; however, at the same time, a bicycle chain, and devices of similar construction, are not free to twist about an axis placed along the length of the chain. Various types of such chains exist such as roller chain, block chain and Ewart chain. A bicycle chain type construction, made in miniature, could serve as a twist-resistant support for a yo-yo of the present invention. Such chains do exist, one class being available in jewelry stores. Other types of fine chains, which are sufficiently flexible to wrap around an axle but which offer considerable resistance to twisting about an axis lying along the length of the chain are also available commercially. Some of these miniature chains are not based on the bicycle chain (roller, block) type of linkage. Another material, known as "metallic cord", also satisfies the above requirements for a twist-resistant yo-yo string. In addition, metallic cord is cheaply available commercially. One type of commercially available metallic cord consists of LUREX woven about multiple strands of rayon fibers. Other types of metallic cord may employ MYLAR in place of, or in conjunction with, the LUREX. However, the present invention is not limited to the above-mentioned specific twist-resistant strings in association with yo-yo type toys.

In another embodiment of the string in the present invention, illustrated in FIG. 2, the string may consist of a segment of torsional resistant string 10 joined at point 11 to a looped segment of a more conventional string 12 such as a laid string.

Figure 3:
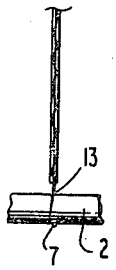
FIG. 3 illustrates another embodiment of the twist-resistant string.

In still another embodiment of the present invention as illustrated in FIG 3, the string may consist of a conventional-type string 13 surrounded in part by a sheath 14 of flexible but twist-resistant material. The sheath 14 must be somewhat tightly bound to, or frictionally engaged with, the string 13 in order to hinder twisting of the string 13 about its longitudinal axis. Some "play" or frictional slip may be allowable between the string 13 and the sheath 14 in order to allow tightening or loosening of the looped string about the axle of the yo-yo similar to the case of a conventional sleeper yo-yo. One method, but by no means exclusive, for forming the sheath 14, is by weaving LUREX or MYLAR around the string 13.

Figure 4:
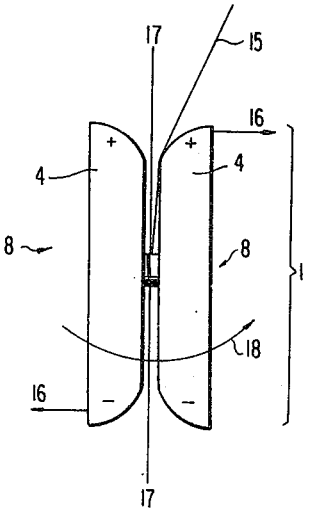
FIG. 4 illustrates the principle of precession as applied to a yo-yo.

Before progressing any further with the present discussion, it is appropriate to discuss the basic physics of precession and explain how it relates to a yo-yo. It will be explained how the present invention successfully solves the problems caused by precession in a yo-yo. Consider the spinning yo-yo body 1 in FIG. 4; the "+" symbols on discs 4 indicate that those portions of the discs are coming out of the plane of the page; the "−" symbols indicate that those portions of the yo-yo are going into the plane of the page. The string 15 is being pulled to the side, tending to topple the yo-yo body 1 in a clockwise manner indicated by arrows 16 as viewed facing FIG. 4. It is a well-known principle of physics that, when a torque is applied to a rotating object, which tends to displace the original axis of rotation, the rotating object will rotate about an axis which is mutually perpendicular to both the original axis of rotation and to the axis of the applied torque. This induced rotation is referred to as precession. In the case of a yo-yo spinning as illustrated in FIG. 4 and subjected to a torque as indicated in FIG. 4, the yo-yo body 1 will spin or precess about an axis lying along the line 17—17 and the direction of precession is indicated by the curved arrow 18. If either the direction of rotation about the axis 8—8, or the direction of the applied torque as indicated by arrows 16 is reversed, the direction of precessional rotation will be reversed, and will occur in the opposite direction to that indicated by the curved arrow 18.

The topic of precession has been discussed and studied extensively in the past. In particular, the precession of spinning tops has been discussed at length in the literature, for example, in "Spinning Tops and Gyroscopic Motion" by J. Perry (1850–1920) republished Dover, New York (1957); "An elementary Treatment of the Theory of Spinning Tops and Gyroscopic Motion" by H. Crabtree, Longmans, Green and Co., London (1923); and "A Treatise on Gyrostatics and Rotational Motion" by A. Gray 1918, republished in 1959 by Dover, New York. In addition, this topic has been treated in numerous journal articles. In contrast, the inventor is not aware of any discussion in the literature relating to the precession of yo-yos. When a yo-yo goes out of control, it generally rotates about the axis of the string. Curiously, it appears that this rotational motion had not been attributed to precession until so explained by my co-pending patent applications Ser. No. 138,729 and Ser. No. 178,628 (filed Aug. 15, 1980). Precession of a yo-yo about the axis of the string had not been discussed in any prior U.S. patents. Isaacson, U.S. Pat. No. 3,175,326, mentions the rotation of a yo-yo "about the axis of the suspending string" but does not attribute it to precession. Isaacson discusses the use of inertial rings in the yo-yo. However, it is worth pointing out here, that, regardless of the actual moment of inertia of the yo-yo body, precession will still occur, as illustrated in FIG. 4, when a torque is applied to the yo-yo body 1 which tends to reorientate its original axis of rotation.

The inventor is not aware of any other patent, or other literature, which addresses the precession of a yo-yo, as discussed in connection with FIG. 4 above. The specific information including directions, provided in FIG. 4 has been checked out experimentally with yo-yos by the inventor and is totally consistent with predictions based on physical principles (see, for example, FIG. 9.20 in "University Physics" by Sears and Zemansky, 4th edition, Addison-Wesley Publishing Co. (1970); or FIG. XXII (page 10) or FIG. 19 (page 37) in "An Elementary Treatment of the Theory of Spinning Tops and Gyroscopic Motion" by H. Crabtree, Longmans, Green and Co., 1923 (originally printed 1909). This confirms that the effect is due to precession and not due to some other cause.

The precession of the yo-yo indicated by the curved arrow 18 of FIG. 4 could be counteracted by applying a torque in the opposite direction to the curved arrow 18 of FIG. 4. Such a torque can be supplied by means of the string 15, if the string is capable of offering a torsional resistance to twisting. Conventional yo-yo strings offer very little resistance to twisting and contribute very little to hindering precession of the yo-yo body. The essence of this invention is the introduction of a string which displays a significant torsional resistance to twisting and is thus capable of counteracting the tendency toward precession by the yo-yo body. The inventor is not aware of any teachings on these specific concepts other than that within my co-pending U.S. patent application, Ser. No. 138,729. Specifically, the inventor is not aware of any use of, or teachings relating to the use of, twist-resistant string in association with yo-yos. My co-pending U.S. patent application Ser. No. 178,628, entitled: "Precession-Resistant Yo-Yo Device" describes an alternative method for combatting the precessional problem in yo-yo type devices.

Figure 5:
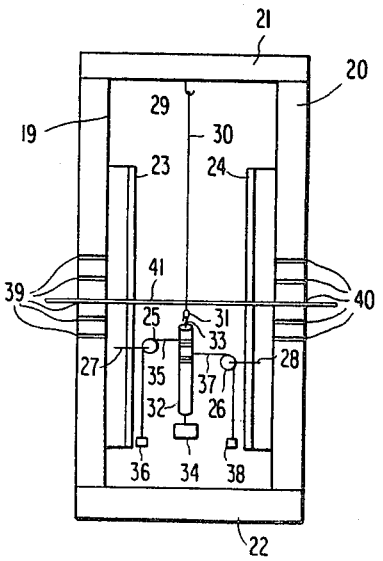
FIG. 5 illustrates an apparatus which was constructed to measure and compare the torsional resistances of various strings.

In order to quantify the torsion-resistance of various types of yo-yo strings, an apparatus of the type illustrated in FIG. 5 was designed and constructed. The members 19 and 20 are vertical supports joined by an upper connector 21 and a lower connector 22. The members 23 and 24 are vertical bars which are connected to supports 19 and 20, respectively. Pulleys 25 and 26 are slidably connected to bars 23 and 24 by means of clamps 27 and 28, respectively. Hook 29 in upper connector 21 supports the string 30. The string 30 has a split ring 31 attached at its lower end. The string 30 is connected, through the split ring 31, to a cylindrical rod 32 of known diameter by means of a hook 33 which is screwed into rod 32. A weight 34 is attached to the lower end of rod 32. A light thread 35 is connected to cylindrical rod 32. The thread 35 lies in the groove of the pulley 25, and there is a known mass 36 suspended from the thread 35. A thread 37 is attached to rod 32 on the opposite side of attachement as thread 35. Thread 35 and thread 37 are attached to rod 32 at slightly different vertical levels, as indicated in FIG. 5. Thread 37 lies in the groove of pulley 26 and has a known mass 38 suspended from it. Weights 36 and 38 are identical. Two series of parallel holes 39 and 40, are arranged in a vertical sequence along support members 19 and 20. The plane containing these sets of holes lies slightly in front of the plane containing the bars 23 and 24. A removable pin 41 can be supported at opposite ends in a corresponding pair of these holes.

The apparatus is operated as follows: the string under study is supported from the hook 29 as indicated above. While disconnected from the string, the rod 32 is manually twisted a specified number of revolutions in a chosen direction, let's say, clockwise as one looks down on the rod from the top. This causes the threads 35 and 37 to wrap around the rod 32 in the same direction, thereby forcing the two weights 36 and 38 to rise. These weights exert a torque or moment on the rod 32 tending to rotate it in the opposite direction to the imposed rotation. After the rod 32 has been rotated a specified number of times, it is connected to the string 30 through the split ring 31 and hook 33. The torque applied by the two weights 36 and 38 causes the rod 32 to rotate in an anticlockwise direction as viewed from above, thus causing the string to be twisted in this direction also. The rod 32 and attached weight 34 will continue to rotate until the opposing torque offered by the twisted string is exactly equal in magnitude to the torque due to the supported weights 36 and 38, at which point equilibrium is reached. If the threads 35 and 37 become completely unwrapped from the rod 32 during this process, the same step is repeated again, by disconnecting the rod 32 from the string 30 and again rotating the rod 32 manually in a clockwise direction, a viewed from the top. During this rewinding, the twisted string is prevented from untwisting by insertion of the pin 41 into the split ring 31, while the pin 41 is supported in the holes 39 and 40.

The total weight suspended from the string 30 is given by the sum of the weights of the split ring 31, the hook 33, the rod 32 and the weight 34, thereby providing a tension in the string.

The torque or moment applied to the rod 32 by the weight 36 is given by the product of the weight 36 and the radius of the rod 32. A similar torque is applied by the weight 38. Since both weights are equal, and since both torques act in the same direction, the total torque is given by the product of one of the weights by the diameter of the rod. The weight of the threads and the radius of the threads are ignored in these calculations due to their very small contributions to the overall measurements. The end-to-end distance of strings generally becomes smaller during twisting; accordingly, clamps 27 and 28 allow the positions of the pulleys 25 and 26 to be adjusted so that the segment of thread 35 between rod 32 and pulley 25, and also the segment of thread 37 between rod 32 and pulley 26, are horizontal prior to taking final measurements.

The torsional resistances of various strings were compared by counting the number of rotations induced in a given length of string by a specified torque. The greater the number of rotations induced in a particular string by a given torque, the smaller the torsional resistance offered by that string. In all of these measurements, a rod 32 of 0.25 inch diameter was used, and the two suspended masses 36 and 38, had weights of either 1 gram or weights of 2 grams each. Thus all experiments were carried out under a total torque of 0.25 gram inch or a torque of 0.50 gram inch. The measured data for a number of string materials are summarized in Table I. All results are the average of at least six separate measurements. Equilibrium was approached from both directions in all experiments in order to compensate for frictional effects within the apparatus. Typically, all individual readings fell within ±5% of the average value, indicating good reproducibility and precision for the measurements. Some strings, in particular the conventional looped or double-stranded yo-yo strings offer a different torsional resistance to twisting in the clockwise and anticlockwise directions; in those cases, the number of revolutions reported in Table I refers to the average for the clockwise and anticlockwise directions.

TABLE I

| Type of String | Length (Inches) | Weight Suspended From String (Grams) | Torque (Gram Inch) | No. of Revolutions |
|---|---|---|---|---|
| Duncan Yo-Yo String | 41.75 | 29.63 | 0.5 | 90 |
| Festival Yo-Yo String | 40.50 | 29.63 | 0.5 | 90 |
| Duracraft Yo-Yo String | 38.25 | 29.63 | 0.5 | 66 |
| Metallic Cord | 40.25 | 29.33 | 0.50 | 0.8 |
| Metallic Cord | 41.00 | 29.33 | 0.50 | 0.4 |
| Duncan Yo-Yo String | 44.00 | 52.15 | 0.25 | 56 |
| Metallic Cord | 44.00 | 51.85 | 0.25 | 0.13 |
| Metallic Cord | 43.50 | 51.85 | 0.25 | 0.40 |
| Braided Nylon (25 Lbs) | 43.00 | 52.15 | 0.25 | 30 |

The yo-yo strings were taken from commercial yo-yos. The data in Table I indicate that typical yo-yo strings having a length of about 40 inches will undergo significantly more than 40 revolutions when subjected to a torque of 0.5 gram inch under a tension of 29.63 grams, and undergo significantly more than 25 revolutions when subjected to a torque of 0.25 gram inch under a tension of 52.15 grams as measured in the manner described above. The twist-resistant strings which are the subject of this application rotate less than 40 complete revolutions under a torque of 0.5 gram inch and a tension of 29.33 grams; and rotate less than 20 complete revolutions under a torque of 0.25 gram inch and a tension of 51.85 grams.

The yo-yo of the present invention is operated in essentially the same manner as a conventional yo-yo. The string 6 may be wound around the axle 2 of the yo-yo simply by wrapping it by hand. In the case of a sleeper, the loop must be made sufficiently tight to "catch" on the axle during winding. To initiate operation of the yo-yo, the body 1 of the yo-yo may be held in one hand and the end 9 of the string 6 may be held in the other hand. The body 1 of the yo-yo is allowed to fall free while still holding one end 9 of the string 6. As the body 1 of the yo-yo falls under the influence of gravity, the body 1 is forced to rotate about its axle 2, with consequent unwrapping of the string 6 from around the axle 2. When the string 6 has become completely unwound, the body of the yo-yo has acquired considerable angular momentum. In the case where the string is anchored to the axle, this angular momentum forces the body 1 of the yo-yo to continue rotating, thus winding the string 6 about the axle 2 in the opposite sense to the manner in which it was wrapped around the axle during its previous downward swing. Consequently, the body 1 of the yo-yo is forced to rise upward again. A gentle upward impulse applied to the string 6 just prior to the yo-yo body 1 reaching the bottom-most part of its swing, allows the up-down oscillation of the yo-yo body 1 to continue indefinitely. This applied impulse compensates for both frictional loss of energy and dissipation of the translational component of the energy which occurs at the bottom of the yo-yo swing, when the body 1 of the yo-yo is forced to change the direction of its translational motion.

In the case of a sleeper, where the axle 2 lies in the loop 7 of the string 6, the rotational momentum of the yo-yo body 1 at the botoom of its swing allows the yo-yo to continue rotating in this position, i.e., sleep, until its rotational kinetic energy is dissipated by friction. However, if the rotating yo-yo is brought out of its sleep, the yo-yo body 1 will again travel up along the string 6, the distance of rise depending on the amount of rotational kinetic energy remaining in the yo-yo. The rotating yo-yo may be brought out of its sleep by jerking the string 6, or alternatively, by relaxing the tension in the string 6.

The most advantageous feature of the present yo-yo compared to the conventional yo-yos and prior modifications thereof is its resistance to engaging in precessional rotation due to the torsional resistance of the string. For example, if during operation of the yo-yo it is vigorously swung sideways, that is, in a direction parallel to the yo-yo axis 8—8, it tends to precess about a vertical axis as illustrated in FIG. 4; this behavior is common to all yo-yos and frequently results in total loss of control over the yo-yo motion. However, in the case of the yo-yo with twist-resistant string of the present invention, the string 6 hinders rotation of the yo-yo body 1 about the longitudinal axis of the string.

It is possible to fabricate the body 1 of the yo-yo from a variety of materials, such as wood; plastic, metal; rubber composite, etc. The body 1 of the yo-yo could be molded or turned as one complete unit, or the disc 4 and axle 2 portions could be made separately and then fastened together by various means, including but not limited to gluing; screwing; wedging; soldering; welding; etc. The axle 2 may or may not contain the groove 3.

One of the modifications which the inventor found to work effectively employs two discs, each of 57 millimeters diameter and separated from each other by 2.5 millimeters by means of an axle of 6 millimeter diameter. The string consists of a 102 centimeter length of metallic cord, manufactured by KNITRIMS of Miami (2431 N. W. 2nd Avenue, Miami, Fla. 33127), and is anchored to the axle by wedging one end of it between the axle and one of the discs during assembly of the yo-yo. These yo-yos also work effectively when suspended from a swivel system (consisting of fisherman's swivels) and a holding ring.

The instant invention is shown and described in what is considered to be the most practical and preferred embodiment. It is recognized, however, that departures may be made therefrom, which are within the scope of the invention, and that obvious modifications will occur to one skilled in the art.

What is claimed is:

1. A toy capable of combined rotational motion about a horizontal axis and translational motion in a vertical direction, comprising:

an axel;

a first disc connected at a center point to said axel;

a second disc connected at a center point to said axel;

a twist-resistant support connected at one end to said axel at a position between said first disc and said second disc;

wherein said support has a twist-resistance such that a length of said support of about 40 inches supporting a weight of about 30 grams will undergo no more than about 30 revolutions of twisting when subjected to a torque of 0.5 gram inch.

2. A toy capable of combined rotational motion about a horizontal axis and translational motion in a vertical direction, as claimed in claim 1, wherein said support is connected to said axle by looping said support about said axle.

3. A toy capable of combined rotational motion about a horizontal axis and translational motion in a vertical direction, as claimed in claim 1, wherein said support is connected to said axle by firmly anchoring said one end of said support to said axle.

4. A toy capable of combined rotational motion about a horizontal axis and translational motion in a vertical direction, as claimed in claim 1, wherein said support is connected to said axle by means of a string connected to said one end of said support with said string looped about said axle.

5. A toy capable of combined rotational motion about a horizontal axis and translational motion in a vertical direction, as claimed in any of claims 1, 2, 3 or 4, wherein said support is comprised of a twist-resistant string.

6. A toy capable of combined rotational motion about a horizontal axis and translational motion in a vertical direction, as claimed in any of claims 1, 2, 3 or 4 further comprising:

a twist-resistant sheath surrounding said support.

7. A toy capable of combined rotational motion about a horizontal axis and translational motion in a vertical direction, as claimed in any of claims 1, 2, 3 or 4 further comprising:

a swivel means connected to the other end of said support.

8. A toy capable of combined rotational motion about a horizontal axis and translational motion in a vertical direction, as claimed in claim 7 further comprising:

a ring for holding the toy attached to said swivel means.

9. A toy capable of combined rotational motion about a horizontal axis and translational motion in a vertical direction, as claimed in claim 1, wherein said support will undergo 1 revolution of twisting or less when subjected to a torque of 0.5 gram inch.

10. A toy capable of combined rotational motion about a horizontal axis and translational motion in a vertical direction, comprising:

an axle;

a first disc connected at a center point to said axle;

a second disc connected at a center point to said axle;

a twist-resistant support comprised of a twist-resistant chain connected at one end of said axle at a position between said first disc and said second disc.

11. A toy capable of combined rotational motion about a horizontal axis and translational motion in a vertical direction, comprising:

an axle;

a first disc connected at a center point to said axle;

a second disc connected at a center point to said axle;

a twist-resistant support comprised of a metallic cord connected at one end of said axle at a position between said first disc and said second disc.

12. A toy capable of combined rotational motion about a horizontal axis and translational motion in a vertical direction, comprising:

an axle;

a first disc connected at a center point to said axle;

a second disc connected at a center point to said axle;

a twist-resistant support connected at one end to said axle at a position between said first disc and said second disc;

wherein said support has a twist-resistance such that a length of said support of about 43 inches, supporting a weight of about 52 grams, will undergo no more than about 25 revolutions of twisting or less when subjected to a torque of about 0.25 gram inch.

13. A toy capable of combined rotational motion about a horizontal axis and translational motion in a vertical direction, as claimed in claim 12, wherein said support will undergo 10 revolutions or less when subjected to a torque of 0.25 gram inch.

* * * * *